US009241515B2

(12) United States Patent
Kim

(10) Patent No.: US 9,241,515 B2
(45) Date of Patent: Jan. 26, 2016

(54) GARMENT HAVING DETACHABLE BACKPACK

(71) Applicant: Yong Chong Kim, Los Angeles, CA (US)

(72) Inventor: Yong Chong Kim, Los Angeles, CA (US)

( * ) Notice: Subject to any disclaimer, the term of this patent is extended or adjusted under 35 U.S.C. 154(b) by 0 days.

(21) Appl. No.: 14/478,934

(22) Filed: Sep. 5, 2014

(65) Prior Publication Data

US 2015/0374044 A1 Dec. 31, 2015

Related U.S. Application Data

(60) Provisional application No. 62/018,432, filed on Jun. 27, 2014.

(51) Int. Cl.
*A41D 13/00* (2006.01)
*A45F 4/12* (2006.01)

(52) U.S. Cl.
CPC ..... *A41D 13/0007* (2013.01); *A45F 4/12* (2013.01); *A41D 2400/48* (2013.01)

(58) Field of Classification Search
CPC ..... A41F 1/00; A41F 15/00; A41F 15/02; A41F 19/00; A41F 3/00; A41F 3/02; A41F 5/00; A45F 3/00; A45F 3/02; A45F 3/04; A45F 3/08; A45F 3/10; A45F 4/00; A45F 4/02; A45F 4/12; A45F 2003/146; A45F 2003/148; A45F 2004/006; A45F 2005/023; A41D 15/00; A41D 15/04; A41D 13/0007; A41D 2400/48
USPC ..... 2/300, 301, 305, 323, 325, 326, 330, 2/334, 336, 338; 224/153, 575, 576, 578, 224/579, 580, 581, 586, 663, 665, 230, 259, 224/260, 264, 269
See application file for complete search history.

(56) References Cited

U.S. PATENT DOCUMENTS

| | | | | |
|---|---|---|---|---|
| 2,970,316 | A * | 2/1961 | Silin | A41D 11/00 2/94 |
| 4,502,155 | A * | 3/1985 | Itoi | A41D 3/00 2/115 |
| 6,230,950 | B1 * | 5/2001 | Heetman | A45C 7/0077 190/107 |
| 6,332,222 | B1 * | 12/2001 | Graham | A41D 3/00 2/69 |
| 7,165,271 | B2 * | 1/2007 | Elen | A41D 3/00 2/301 |
| 7,788,736 | B2 * | 9/2010 | Gollin | A41D 3/00 2/467 |
| 8,141,757 | B2 * | 3/2012 | Headley | A45F 4/02 224/153 |
| 8,844,062 | B2 * | 9/2014 | Tirard | F41H 1/02 2/102 |
| 2010/0282803 | A1 * | 11/2010 | Simmons | A41D 13/0007 224/576 |
| 2014/0263517 | A1 * | 9/2014 | Redli | A45F 3/04 224/576 |

* cited by examiner

*Primary Examiner* — Andrew W Collins
(74) *Attorney, Agent, or Firm* — East West Law Group; Heedong Chae

(57) ABSTRACT

A garment having a detachable backpack includes a first strap and a second strap; a first pouch and a second pouch wherein one end of the first strap is attached to the first pouch and one end of the second strap is attached to the second pouch; and a first backpack wherein the first backpack is constructed to be detachably attachable to the first and second pouches. The first and second pouches are constructed to be detachably attached a back of the garment. In addition, the first backpack and the first and second pouches are constructed such that the first backpack can be rolled up and received and contained in either the first or second pouch.

17 Claims, 9 Drawing Sheets

GARMENT HAVING DETACHABLE BACKPACK

CROSS-REFERENCE TO RELATED APPLICATIONS

This application claims priority to U.S. provisional application No. 62/018,432 filed Jun. 27, 2014 which is incorporated herein by reference.

FIELD OF THE INVENTION

The present invention relates to a garment having a detachable backpack. The detachable backpack can be attached to a back panel of a shirt or a jacket.

SUMMARY OF THE INVENTION

The present invention provides a garment having a detachable backpack.

The object of the present invention is to provide a garment having a detachable backpack. The detachable backpack is detachably attached to two detachable pouches which are detachably attached to a back panel of the garment. The detachable backpack is supported by two straps. The straps penetrate through the holes on the shoulders of the garment so that they are not visible from the front view of the garment. Then, the straps are attached to the pants using clips, clasps or other suitable means which is usually used for suspenders.

Another object of the present invention is to provide a garment having a detachable backpack, which includes a first strap and a second strap; a first pouch and a second pouch wherein one end of the first strap is attached to the first pouch and one end of the second strap is attached to the second pouch; and a first backpack wherein the first backpack is constructed to be detachably attachable to the first and second pouches. The first and second pouches are constructed to be detachably attached a back of the garment. In addition, the first backpack and the first and second pouches are constructed such that the first backpack can be rolled up and received and contained in either the first or second pouch.

Still another object of the present invention is to provide a garment having a detachable backpack, which includes a backpack having a first strap and a second strap; and an attachment means to attach the backpack to a back of the garment.

Still another object of the present invention is to provide a garment having a detachable backpack, which includes a pouch detachably attached inside of the garment; a backpack contained in the pouch; and an attachment means formed on a back of the garment. The backpack can be attached to the back of the garment by the attachment means.

The advantages of the present invention are: (1) the present invention is easy to manufacture and use, pleasing in appearance, and functionally superior by the use of a backpack; (2) the detachable backpack can be structurally securely fastened to a garment by the straps; and (3) the detachable backpack can be rolled up onto the pouch and thus, it is not visible if not in use.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein:

FIG. 1(*b*) shows another rear view of the garment having a detachable backpack wherein the two detachable pouches are flipped outside to expose the attachment means;

FIG. 1(*c*) shows a rear view of the garment having a detachable backpack wherein the two detachable pouches are open;

FIG. 2(*b*) shows a rear view of the second detachable backpack;

FIG. 3(*b*) shows the second detachable backpack attached to the pouches;

FIG. 4(*b*) shows a front view of the garment having a detachable backpack wherein the front fabrics of the garment are open to expose straps therein;

FIG. 6(*b*) shows suspenders having an attachment means for the detachable backpack to be attached thereto;

FIG. 7(*b*) shows the detachable backpack of FIG. 7(*a*);

FIG. 7(*c*) shows the detachable backpack attached to the back of the garment; and FIG. 7(*d*) shows another view of the detachable backpack attached to the back of the garment.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1A:
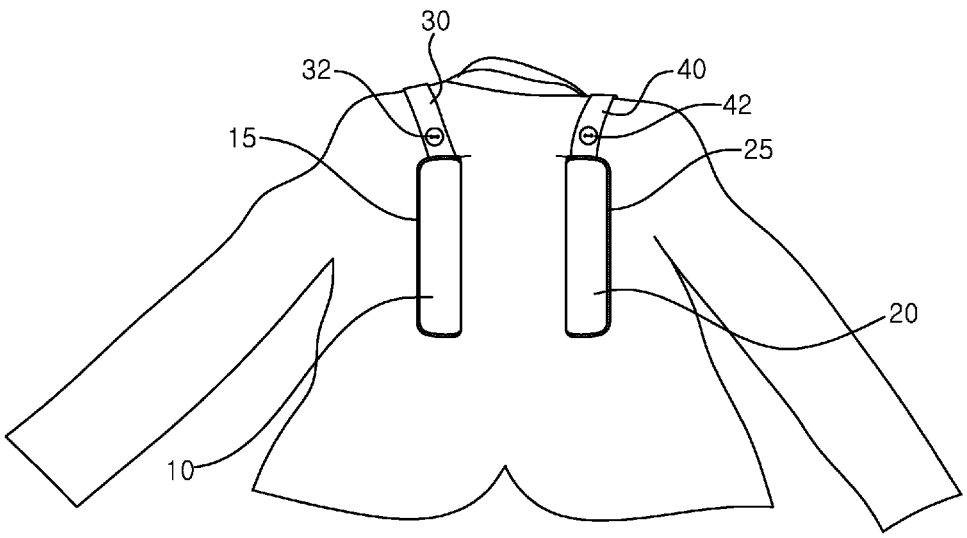
FIG. 1(*a*) shows a rear view of the garment having a detachable backpack.
Figure 1B:
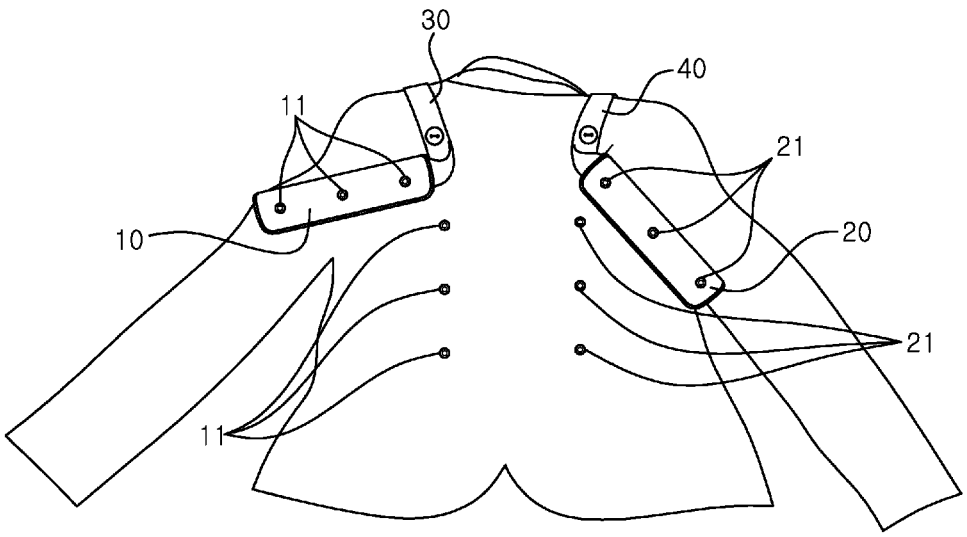
Figure 1C:
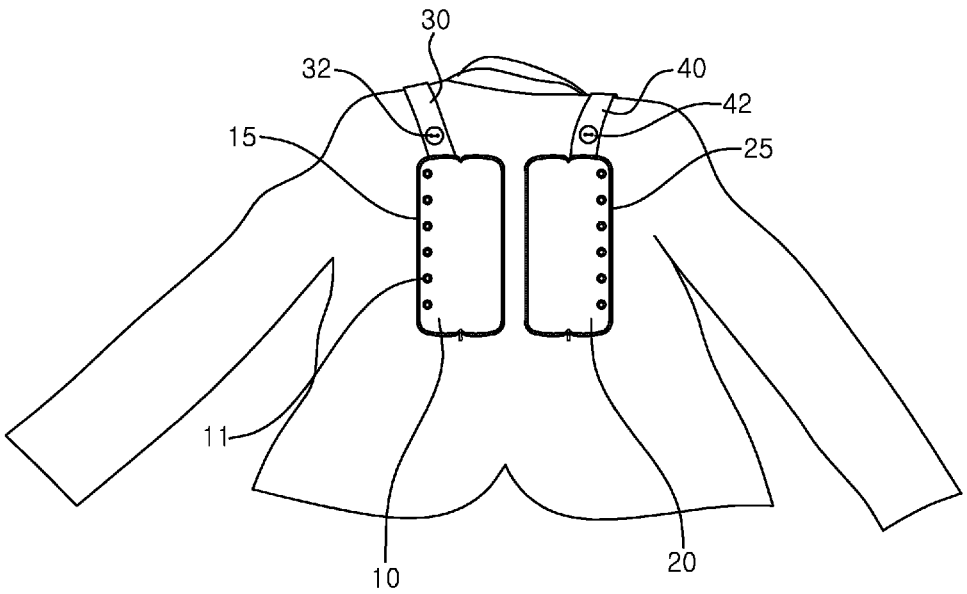

FIG. 1(*a*) shows a rear view of the garment 100 having a detachable backpack 50, 60 and FIG. 1(*b*) shows another rear view of the garment 100 having a detachable backpack 50, 60 wherein the two detachable pouches 10, 20 are flipped outside to expose the attachment means 11, 21. In addition, FIG. 1(*c*) shows a rear view of the garment 100 having a detachable backpack 50, 60 wherein the two detachable pouches 10, 20 are open.

The garment 100 having a detachable backpack 50, 60, includes a first strap 30 and a second strap 40; a first pouch 10 and a second pouch 20 such that one end of the first strap 30 is attached to the first pouch 10 and one end of the second strap 40 is attached to the second pouch 20; and a first backpack 50 wherein the first backpack 50 or 60 is constructed to be detachably attachable to the first and second pouches 10, 20. The first and second pouches 10, 20 are constructed to be detachably attached a back of the garment 100, and the first backpack 50 or 60 and the first and second pouches 10, 20 are constructed such that the first backpack 50 or 60 can be rolled up and received and contained in either the first 10 or second pouch 20.

The one end of the first strap 30 may be provided with an attachment means 32 to detachably attach the one end of the first strap 30 to the back of the garment 100, and the one end of the second strap 40 may be also provided with an attachment means 42 to attach the one end of the second strap 40 to the back of the garment 100.

The attachment means 32 to detachably attach the one end of the first strap 30 to the back of the garment 100 may be preferably a button and a buttonhole, and the attachment means 42 to detachably attach the one end of the second strap 40 to the back of the garment 100 may be preferably a button and a buttonhole. Preferably, the buttons are fixedly formed and attached to the back of the garment 100 and the buttonholes are formed respectively on the one ends of the first and second straps 30, 40.

The one end of the first strap 30 may be attached to the first pouch 10 by sewing and the one end of the second strap 40 may be also attached to the second pouch 20 by sewing.

Figure 2A:
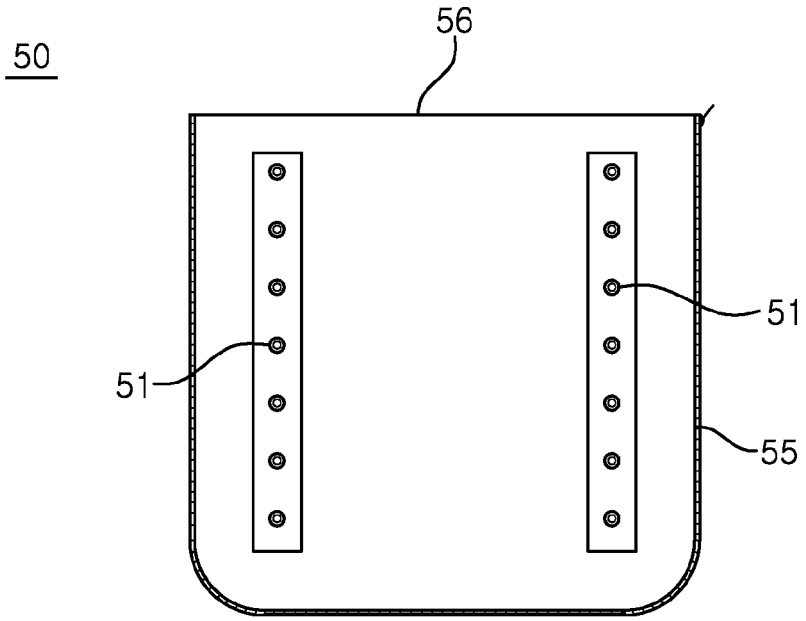
FIG. 2(*a*) shows a rear view of the first detachable backpack.
Figure 2B:
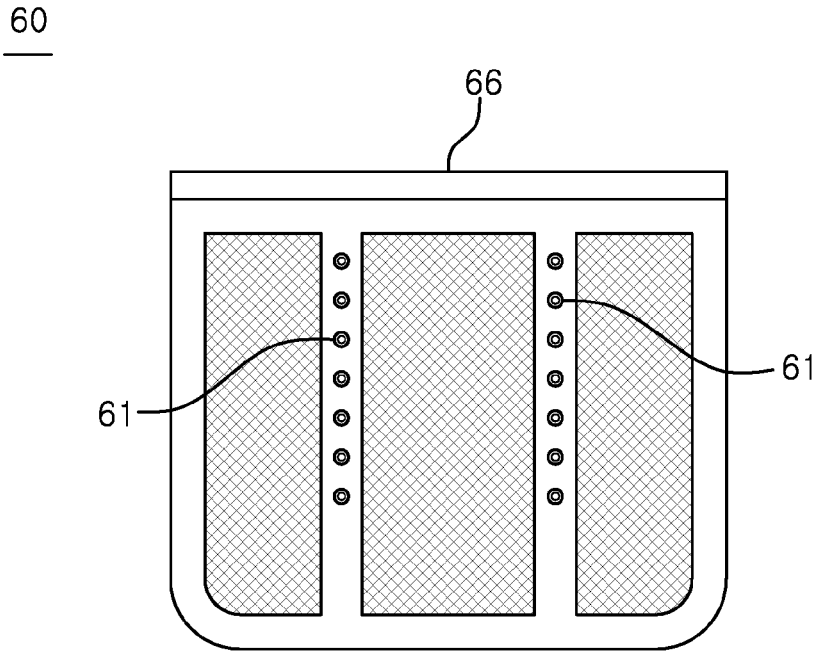

FIGS. 2(*a*) and 2(*b*) respectively show a rear view of the first and second detachable backpacks.

The first backpack 50 is attachable to the first and second pouches 10, 20 when the first and second pouches 10, 20 are open. Preferably, the first backpack 50 is attachable to the first and second pouches 10, 20 by snap fasteners 11, 51. Preferably, there are two rows of the snap fasteners 51, 61 to be mated with the corresponding snap fasteners 11 of the detachable pouches 10, 20.

The first backpack 50 may be provided with an opening means 55 such as a zipper and an opening 56 through which an item can be placed in the backpack 50. There may be one or two zipper slides.

The first and second pouches 10, 20 are provided with an opening means 15, 25 and the opening means 15, 25 are zippers.

The present invention further includes a second backpack 60 and the second backpack 60 is also constructed to be detachably attachable to the first and second pouches 10, 20.

The second backpack 60 and the first and second pouches 10, 20 are also constructed such that the second backpack 60 can be rolled up and received and contained in either the first or second pouch 10, 20.

Figure 3A:
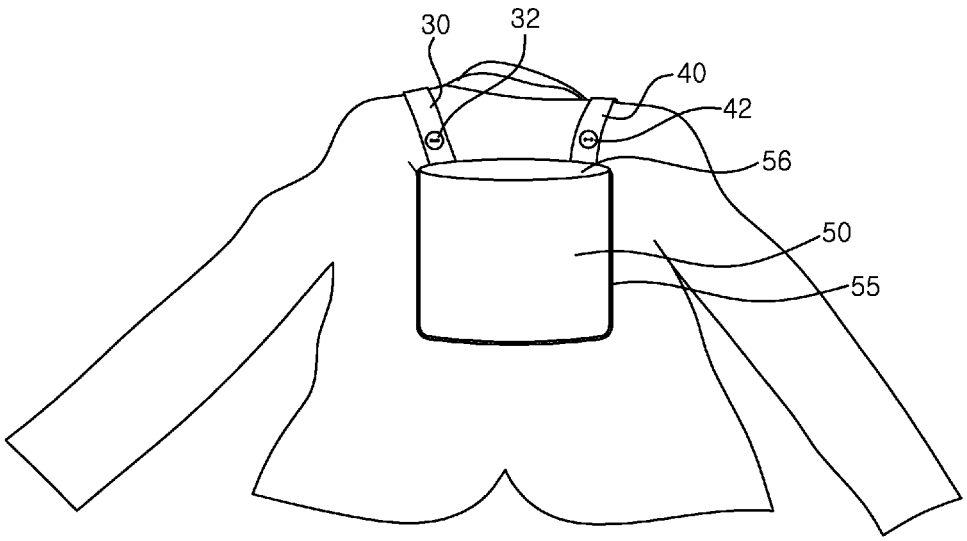
FIG. 3(*a*) shows the first detachable backpack attached to the pouches.
Figure 3B:
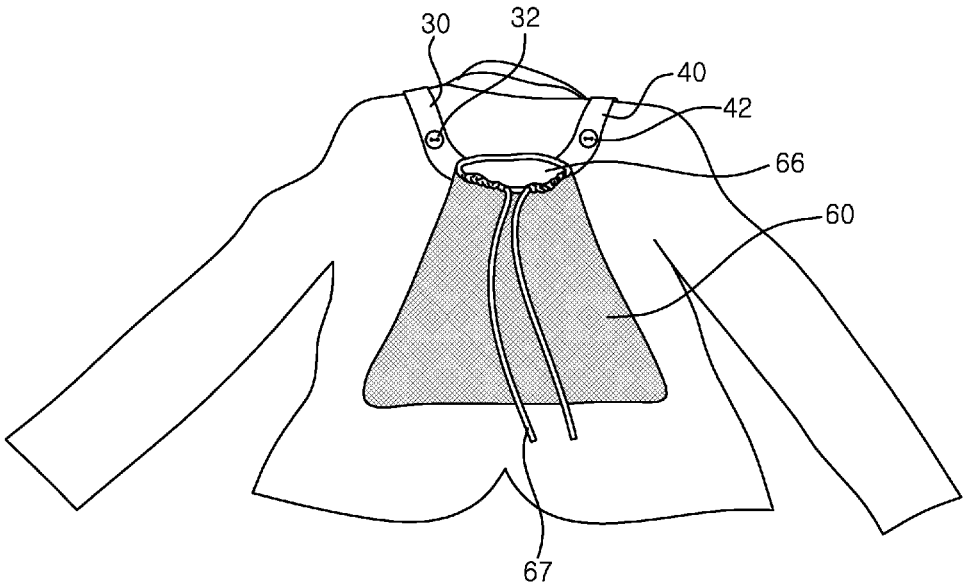

As shown in FIGS. 2(*a*) and 2(*b*), the first and second backpack 50, 60 may be different kind of backpacks. FIGS. 3(*a*) and 3(*b*) respectively show the first and second detachable backpacks 50, 60 attached to the pouches 10, 20. The draw string 67 of the detachable mesh bag 60 is pulled to close the detachable mesh bag 60. When the first backpack 50 is in use, the second backpack 60 can be placed into the first backpack 50 and vice versa.

Figure 4A:
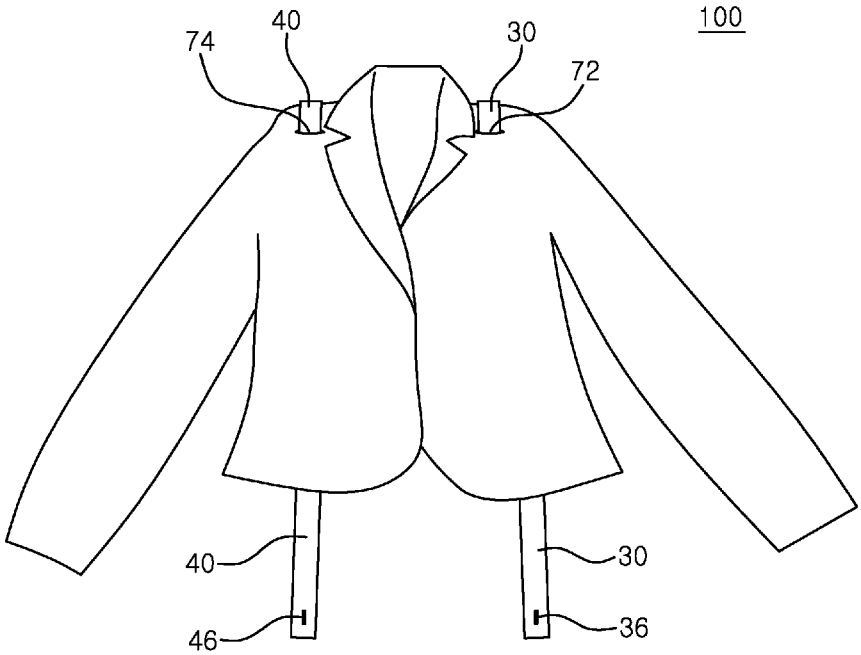
FIG. 4(*a*) shows a front view of a garment having a detachable backpack showing the straps.
Figure 4B:
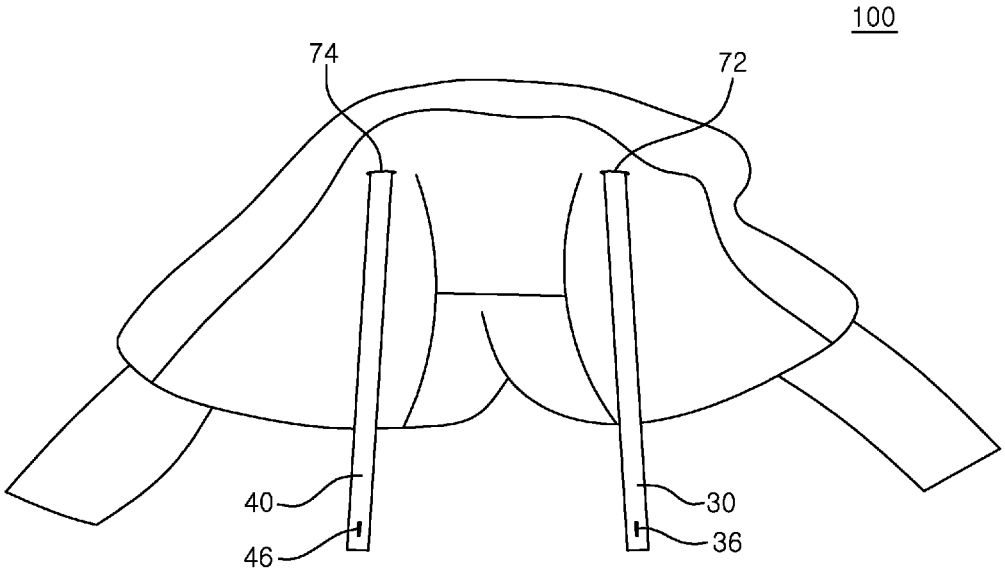

FIG. 4(*a*) shows a front view of a garment having a detachable backpack showing the straps and FIG. 4(*b*) shows a front view of the garment having a detachable backpack wherein the front fabrics of the garment are open to expose straps therein.

Another end of the first strap 30 is provided with a first strap attachment means 46 in order for the first strap 30 to be detachably attached to pants, trousers, shorts, skirt, or a belt and another end of the second strap 40 is also provided with a second strap attachment means 46 in order for the second strap 40 to be detachably attached to pants, trousers, shorts, skirt, or a belt.

The straps 30, 49 are spaced apart and attached to pants, trousers, shorts, skirt, or a belt to effectively support the detachable backpack 50, 60 attached to the rear side of the garment 100.

The garment 100 may further comprise a first shoulder opening 72 and a second shoulder opening 74 wherein the first and second straps 30, 40 are inserted respectively into the first and second shoulder openings 72, 74 such that the first and second straps 30, 40 are not visible from front view of the garment 100.

The garment 100 further comprises a first closing means and a second closing means wherein the first and second closing means close respectively the first and second shoulder openings 72, 74 when the straps 30, 40 are not inserted therein. Preferably, the first and second closing means are zippers.

Figure 5:
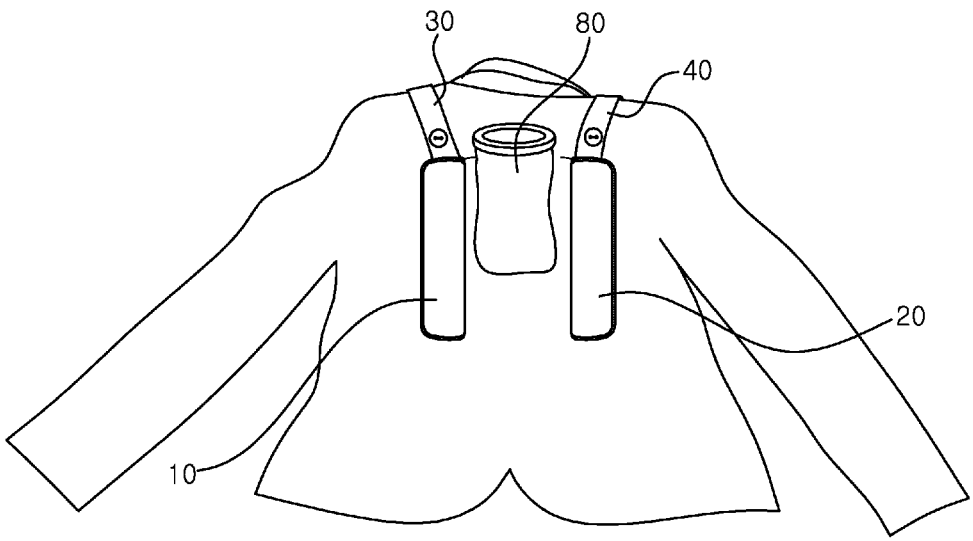
FIG. 5 shows a rear view of the garment having a detachable backpack showing the third detachable backpack.

FIG. 5 shows a rear view of the garment 100 having a detachable backpack showing the third detachable backpack 80. The third backpack 80 is constructed to be detachably attachable to the back of the garment between the first and second straps 30, 40 by an attachment means for the third backpack 80. The attachment means for the third backpack 80 may be button and buttonhole and snap fasteners may be additionally used. Head of the third backpack 80 is made of round metal such that the radius of the round metal can be adjusted preferably by a screw.

Figure 6A:
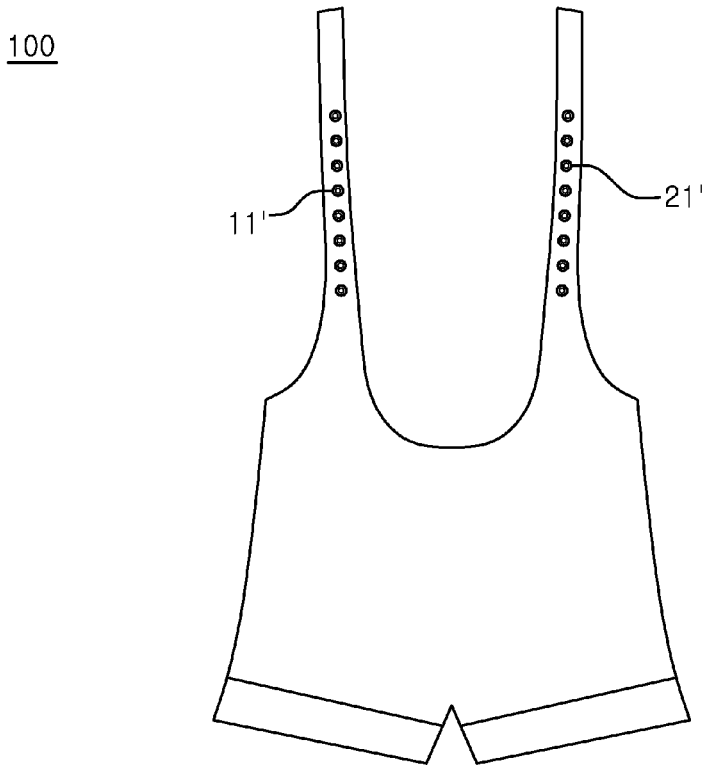
FIG. 6(*a*) shows suspender trousers having an attachment means for the detachable backpack to be attached thereto.
Figure 6B:
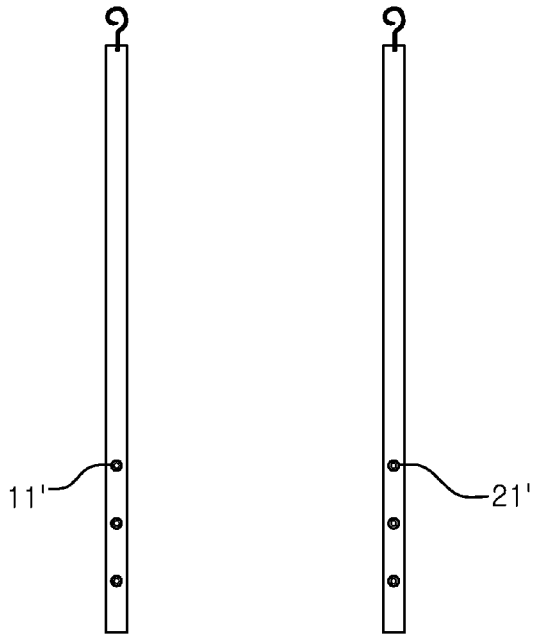
Figure 7A:
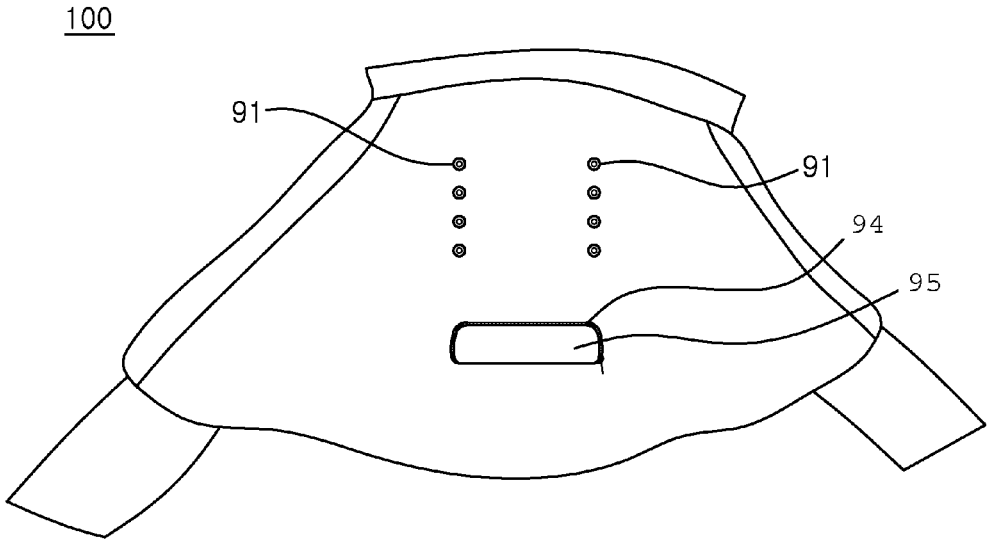
FIG. 7(*a*) shows a front view of the garment having an attachment means for a detachable backpack and a pouch containing the detachable backpack.
Figure 7B:
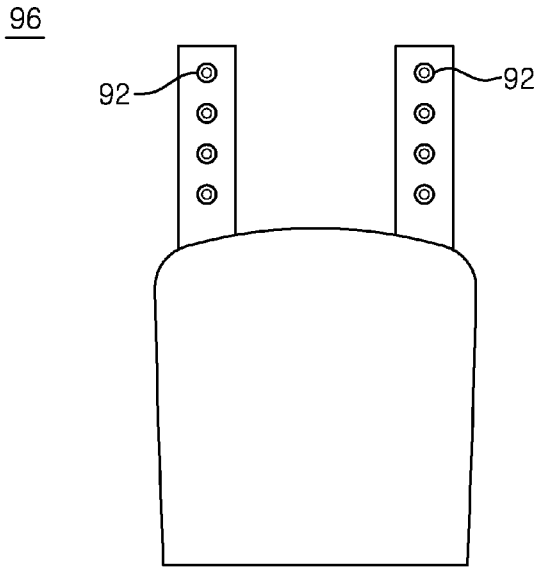
Figure 7C:
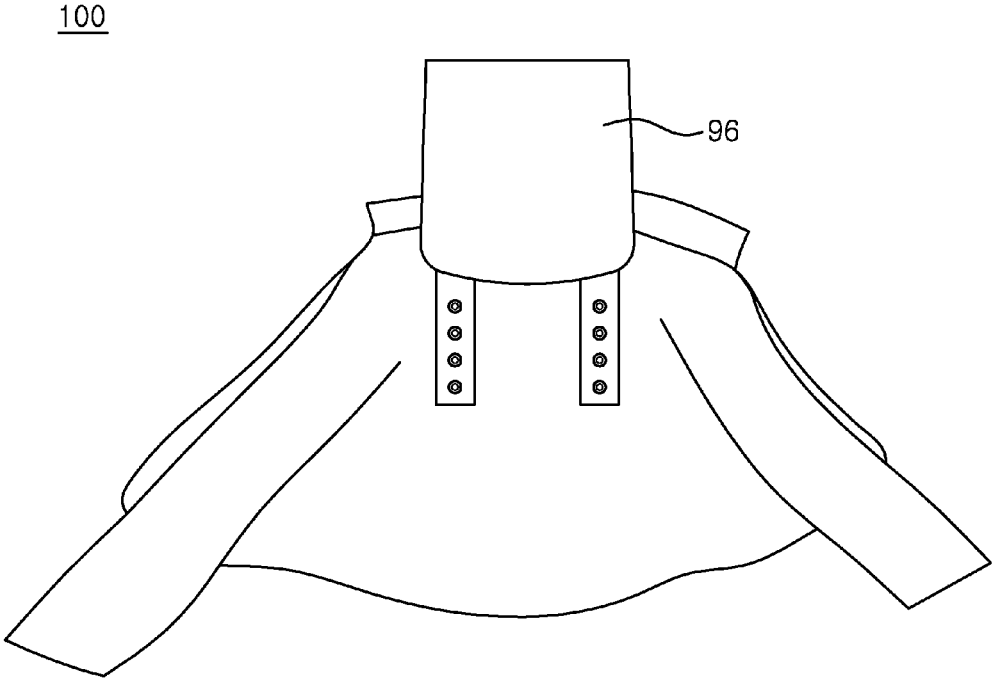
Figure 7D:
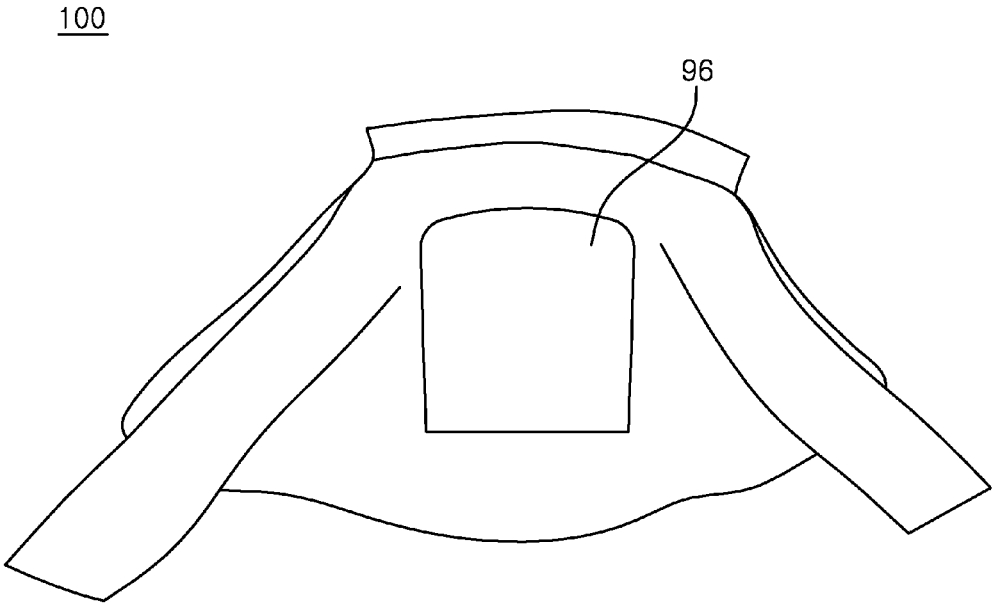

FIG. 6(*a*) shows suspender trousers having an attachment means 11', 21' for the detachable backpack to be attached thereto. FIG. 6(*a*) is preferably a rear view, but it may be a front view. FIG. 6(*b*) shows suspenders having an attachment means for the detachable backpack to be attached thereto.

There are two rows of snap fasteners 11', 21' longer than those mating snap fasteners of the backpack 50 or mesh bag 60 so that the attachment location of the backpack 50 or mesh bag 60 can be adjusted.

The suspenders of FIG. 6(*b*) are also provided with attachment means 11', 21' for the detachable pouches or the detachable backpack or mesh bag, and the ends of the suspenders are provided with attachment means such as clasps, clips, and so forth.

FIGS. 7(*a*)~7(*d*) show still another embodiment of the present invention. FIG. 7(*a*) shows a front view of the garment 100 having an attachment means 91 for a detachable backpack 96 and a pouch 95 containing the detachable backpack 96 therein. FIG. 7(*b*) shows the detachable backpack 96 and FIGS. 7(*c*) and 7(*d*) show the detachable backpack 96 attached to the back of the garment 100. The pouch 95 is detachably attached to inside of the garment 100 as shown in FIG. 7(*a*). The backpack 96 is preferably made of fabric and provided with an attachment means 92 to be attached to the attachment means 91 of the garment 100. The backpack 96 can be rolled and placed in the pouch 95. The attachment means 91, 92 may be snap fasteners as in FIGS. 7(*a*) and 7(*b*) or a zipper. When the attachment means 92 of the backpack 96 is a zipper, it is formed along an edge of the backpack 96.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A garment having a detachable backpack, comprising:

a first strap and a second strap;

a first pouch and a second pouch wherein one end of the first strap is attached to the first pouch and one end of the second strap is attached to the second pouch; and a first backpack wherein the first backpack is constructed to be detachably attachable to the first and second pouches, wherein the first and second pouches are constructed to be detachably attached a back of the garment, and wherein the first backpack and the first and second pouches are constructed such that the first backpack can be rolled up and received and contained in either the first or second pouch.

2. The garment of claim 1, wherein the one end of the first strap is provided with an attachment means to detachably attach the one end of the first strap to the back of the garment, and the one end of the second strap is provided with an attachment means to attach the one end of the second strap to the back of the garment.

3. The garment of claim 2, wherein the attachment means to detachably attach the one end of the first strap to the back of the garment is a button and a buttonhole, and the attachment means to detachably attach the one end of the second strap to the back of the garment is a button and a buttonhole.

4. The garment of claim 3, wherein the buttons are fixedly formed and attached to the back of the garment and the buttonholes are formed respectively on the one ends of the first and second straps.

5. The garment of claim 1, wherein another end of the first strap is provided with a first strap attachment means in order for the first strap to be detachably attached to pants, trousers, shorts, skirt, or a belt; and another end of the second strap is provided with a second strap attachment means in order for the second strap to be detachably attached to pants, trousers, shorts, skirt, or a belt.

6. The garment of claim 1, further comprising a first shoulder opening and a second shoulder opening wherein the first and second straps are inserted respectively into the first and second shoulder openings such that the first and second straps are not visible from front view of the garment.

7. The garment of claim 6, further comprising a first closing means and a second closing means wherein the first and second closing means close respectively the first and second shoulder openings when the straps are not inserted therein.

8. The garment of claim 7, wherein the first and second closing means are zippers.

9. The garment of claim 1, wherein the first backpack is attachable to the first and second pouches when the first and second pouches are open.

10. The garment of claim 9, wherein the first backpack is attachable to the first and second pouches by snap fasteners.

11. The garment of claim 1, wherein the first and second pouches are provided with an opening means and the opening means are zippers.

12. The garment of claim 1, further comprising a second backpack wherein the second backpack is constructed to be detachably attachable to the first and second pouches.

13. The garment of claim 12, wherein the second backpack and the first and second pouches are constructed such that the second backpack can be rolled up and received and contained in either the first or second pouch.

14. The garment of claim 13, wherein the first and second backpack are different kind of backpacks.

15. The garment of claim 14, further comprising a third backpack wherein the third backpack is constructed to be detachably attachable to the back of the garment between the first and second straps by an attachment means for the third backpack.

16. The garment of claim 15, wherein the attachment means for the third backpack is button and buttonhole.

17. The garment of claim 1, wherein the one end of the first strap is attached to the first pouch by sewing and the one end of the second strap is attached to the second pouch by sewing.

* * * * *